United States Patent [19]

Jourde

[11] 4,440,133

[45] Apr. 3, 1984

[54] DEVICE FOR PREMETERED PRESSURE-TIME INJECTION

[75] Inventor: Jean-Pierre Jourde, Lyons, France

[73] Assignee: Regie Nationale des Usines Renault, Boulogne-Billancourt, France

[21] Appl. No.: 424,916

[22] Filed: Sep. 27, 1982

[30] Foreign Application Priority Data

Oct. 15, 1981 [FR] France ..... 81 19395

[51] Int. Cl.[3] ..... F02M 39/00

[52] U.S. Cl. ..... 123/446; 123/450; 123/458

[58] Field of Search ..... 123/446, 450, 447, 458

[56] References Cited

U.S. PATENT DOCUMENTS

| | | | |
|---|---|---|---|
| 3,516,395 | 6/1970 | Bassot et al. | 123/446 |
| 4,249,497 | 2/1981 | Eheim et al. | 123/446 |
| 4,273,087 | 6/1981 | Goloff | 123/446 |
| 4,295,449 | 10/1981 | Cemenska et al. | 123/450 |
| 4,364,360 | 12/1982 | Eheim et al. | 123/450 |
| 4,372,272 | 2/1983 | Walter et al. | 123/450 |
| 4,381,750 | 5/1983 | Funada | 123/446 |
| 4,398,519 | 8/1983 | Tissot et al. | 123/459 |

FOREIGN PATENT DOCUMENTS 24115 2/1981 European Pat. Off. .

*Primary Examiner*—Ira S. Lazarus
*Assistant Examiner*—Magdalen Moy
*Attorney, Agent, or Firm*—Oblon, Fisher, Spivak, McClelland & Maier

[57] ABSTRACT

An electronically controlled device for premetered pressure-time injection using high injection pressure and low feed pressure, which include one source (5-6) of medium pressure (MP) which is intermediate the high and low pressures, a two-stage rotary distributor which cyclically distributes the high and low pressure into single piping systems for each cylinder, a plurality of injection nozzles wherein, in each injector nozzle (30), a metering piston is provided (8) whose delivery chamber (21) is connected to the single piping system, and an injector control piston (11) having a control chamber (31) which is connected, via a three-channel electrovalve (9), through a medium pressure channel for the purposes of initiating injection, and through a second channel to the injection chamber (22) for purposes of initiating metering.

5 Claims, 8 Drawing Figures

DEVICE FOR PREMETERED PRESSURE-TIME INJECTION

BACKGROUND OF THE INVENTION

1. Field of the Invention

The invention relates to the direct injection of fuel into internal combuston engines, in particular diesel motors.

2. Description of the Prior Art

It is known that to achieve complete combustion and desired power from diesel motors, injection must be carried out at a constant high pressure. To deal with this problem, there are already known injection devices of the pressure-time type featuring electromagnetic control, but these have certain drawbacks. Indeed, given the high injection rates called for by modern engines because of the high degree of supercharging for industrial vehicle motors or the high revolutions per minute for passenger car engines, the time allotted for injecting the amounts of fuel corresponding to a light load or a slow operating speed is quite short, and is on the same order of magnitude as the response time of the electromagnetic switches used to make the injector function.

To avoid this problem, there are known solutions involving the use of two electronic valves or servovalves for each injector, with one valve reserved for pressure control of the initiation of injection and the other valve serving to control the end of injection. These two control units execute the injection function perfectly but present other drawbacks. First of all, the injection nozzle is relatively bulky, making it difficult to install in the heads of the motor, especially in the case of passenger car engines. Second, the inevitable variance in response time results in irregularities between injection nozzles. Finally, the very design of the electromagnetic electrovalves or servovalves, which must have a rapid response time, inevitably causes leaks, not around the seats but as a result of cylinder-piston play, which have a major impact on the amount of fuel injected during the course of the same control period.

To avoid the latter problems, one known solution involves providing devices which amount to distributor-linked central hydraulic units in which the pressure control part of the injector (electroservovalves) is shared by several injectors, and the injection functions are distributed to the injection nozzles. While such a design ensures homogeneous operation by several injectors, it has, on the other hand, the drawback of giving rise to harmful hydraulic effects in the lines connecting the injection pressure control unit with the injector nozzles. In addition, given that there is a continuous high injection pressure around the injector needles, any improper functioning of the control unit poses a significant risk of flooding the engine, which justifies the addition of flow restriction units in the device.

SUMMARY OF THE INVENTION

The object of the invention is to eliminate the above-noted drawbacks by producing a device for premetered pressure-time injection which isolates the high pressure from the injection pressure pump while allowing for premetering of the amount of fuel injected, thereby avoiding most of the hydraulic effects harmful to the high pressure and the control. Another object is to use only one electromagnetic part per cylinder, with the hydraulic circuit being designed in such a way that the unavoidable leaks from this electromagnetic part do not diminish the amount of fuel injected.

The invention consists of providing not only for the customary high injection pressure and low feed pressure, but for a medium pressure intermediate said pressure, in using a dual revolving distributor driven synchronously with the camshaft and alternatively distributing high and low pressure through a single piping system for each injector, in providing each injection nozzle with a metering piston which moves between a delivery chamber connected to the said single piping system and a metering chamber connected to the injector needle area, with a conventional system of passages for the discharge of said needle area and the needle control chamber when the piston reaches the end of its stroke, and finally in connecting this control chamber via a unidirectional flow valve to the medium feed pressure, and alternatively via a three-channel electrovalve to the medium pressure at the time injection is initiated, and to the metering chamber at the time metering is initiated, with the end of the metering period being determined by the cessation of low-pressure distribution by the distributor and the end of injection being determined by the end of the stroke of the metering piston.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designed like or corresponding parts through the several views and wherein.

DETAILED DESCRIPTION OF THE PREFERRED EMBODIMENTS

Figure 1:
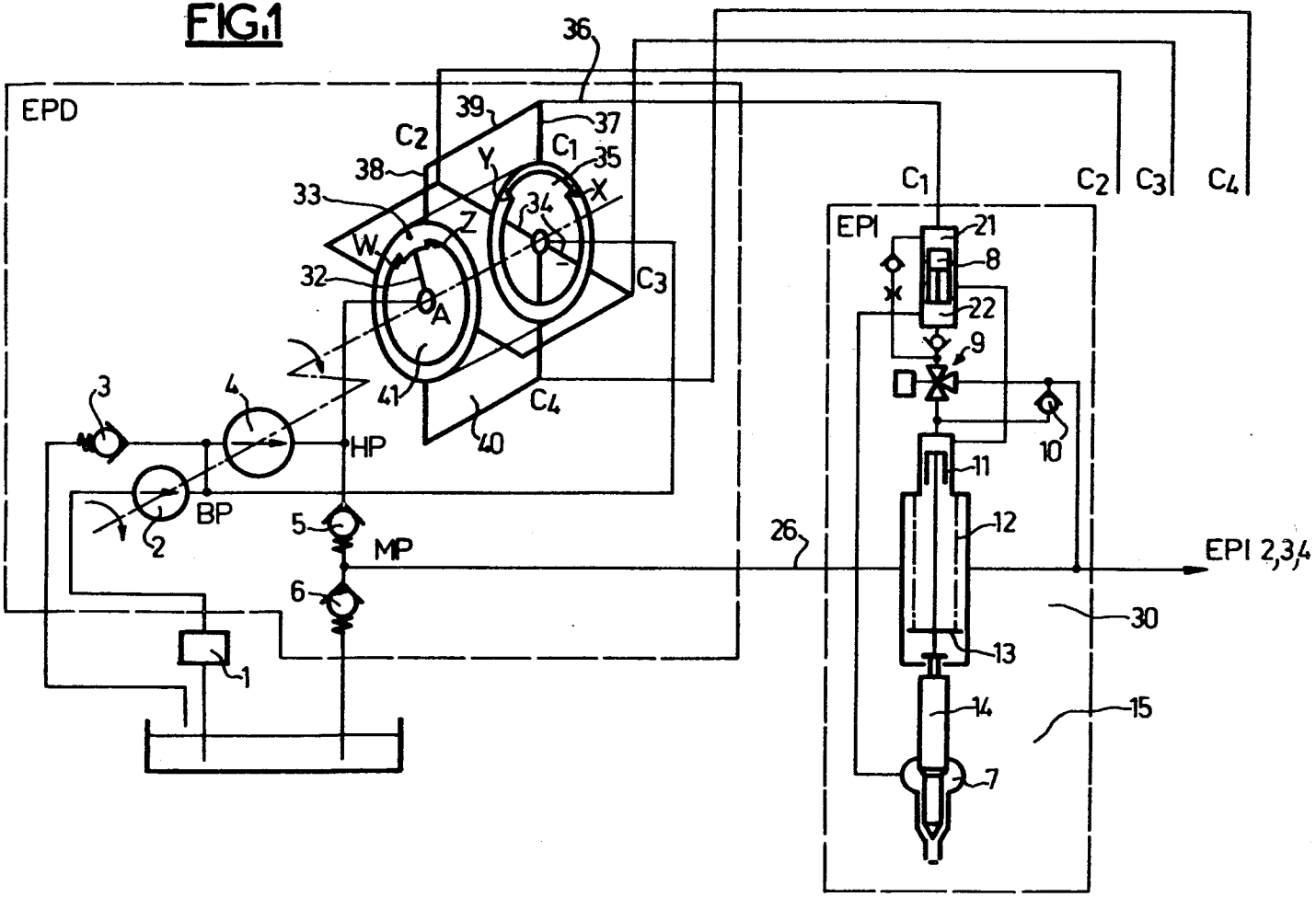
FIG. 1 is a general hydraulic circuit diagram of the device.

The device taken as an example corresponds to a four-cylinder engine and includes a single distribution pump unit corresponding to the box framed by dashes on the left side of FIG. 1 and designed EPD, this unit being connected by four piping systems, $C_1$, $C_2$, $C_3$ and $C_4$ to four injector nozzle units EPI, of which only one is represented in FIG. 1 and each of which corresponds to one of the cylinders.

The distribution pump unit EPD entails two pumps 2 and 4 which revolve synchronously and are driven by the engine, either at engine speed or at half-speed like the camshaft. The fuel is drawn from the fuel tank through a filter 1 by the fuel pump 2. The feed pressure of the fuel pump, or low pressure BP (5 to 10 bars) is governed by regulator 3. The fuel is then brought to high pressure HP (e.g., up to 1,000 bars) by pump 4, with said high pressure HP being regulated by regulator 5. Finally, a third regulator 6 is inserted between the output of regulator 5 and the tank return line, and generates a medium pressure MP on the order of 30 to 40 bars.

The stator 40 of the distribution pump has an inside diameter such that a rotor 41 may rotate at half engine speed for a four-cycle engine or at engine speed for a two-cycle engine. This rotor has two stages, namely a stage A at high pressure and a stage B at low pressure.

Fuel at high pressure HP enters stage A axially and is channeled through a radial boring 32 into an open space 33 with a 15° to 20° arc. The stator is penetrated by lines 36, 37, 38 and 39 connected to piping system $C_1$, with lines 38 and 37 corresponding to stages A and B, respectively. Naturally, there are three other series of analogous borings which correspond to the three other connecting piping systems $C_2$, $C_3$ and $C_4$ and are arranged cyclically within the stator 40 in the conventional fuel feed sequence of "1-3-4-2".

The inside area at the center of stage B is tied into the lower pressure BP, and radial lines 34 distribute this pressure into a large open area which is obstructed for about 20 degrees of arc by circular boss 35. The open area 33 and the box 35 are arranged and fixed on the rotor 41 in such a way that when lines 38, 39 and 36 are connected to high pressure, there can be no connection with low pressure through line 37, and when lines 36 and 37 are connected to low pressure, no high pressure reaches line 38.

Figure 2:
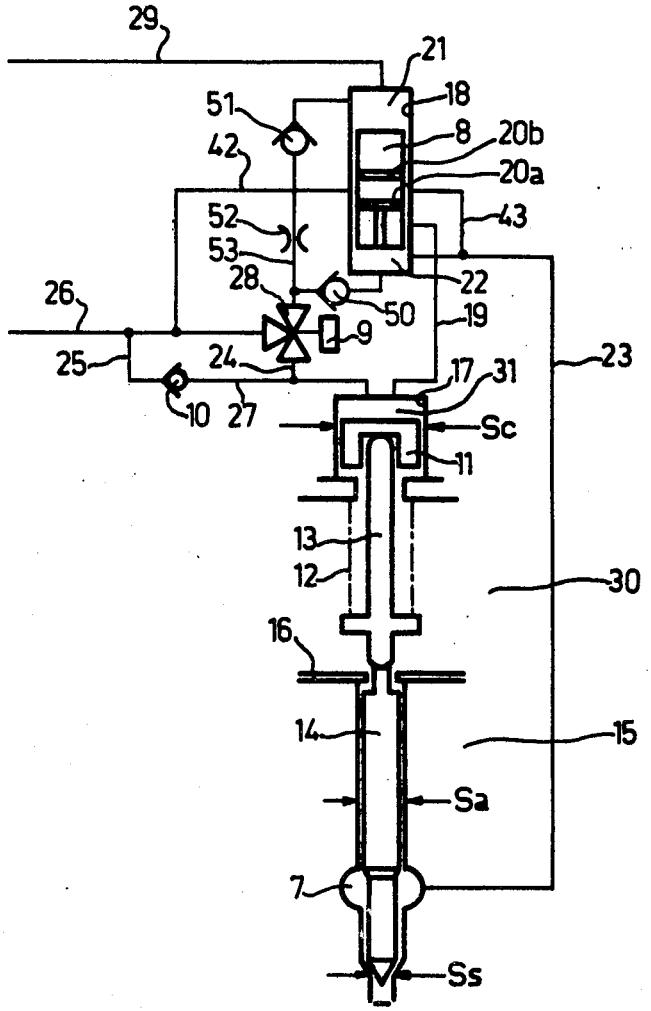
FIG. 2 is a detailed diagram of an injector and the injection nozzle.

The injector nozzle unit EPI entails the injector 15 and the injector nozzle 30, represented in greater detail in FIG. 2. The unit is assembled so as to include in a boring 18, a piston 8 whose upper surface forms, with the boring 18, a delivery chamber 21 which is connected to the high pressure input via a line 29, corresponding to $C_1$, $C_2$, $C_3$, or $C_4$, depending on the case, while its lower surface forms a metering and injection chamber 22. In addition, the piston 8 is penetrated by passages **20*a* and 20*b* which make it possible, when the piston is in its lower position and thus giving the injection chamber 22 its minimum volume, to connect chamber 22 with a line 19 and connect line 23 with the medium pressure line 26 via line 43 and passage 42**.

The unit also includes in a boring 17, a control piston 11 whose upper surface forms, with boring 17, a control chamber 31, the lower surface of the control piston 11 being in contact with a pushrod 13 whose other end rests on the needle 14 of the injector. The injector's nozzle 15 and stroke chock 16 are attached by known means to the injection nozzle 30. The injector 15 as well as its spring 12 are of a conventional type.

A three-channel electromagnetically controlled valve 9 is also included whose common channel is connected via line 24 to the control chamber 31, with the first channel 28 being connected to, on the other hand, the injection chamber 22, with a unidirectional flow valve 50 being inserted in the line in such a way that the fuel may not pass from the injection chamber 22 toward the first channel 28, and on the other hand, to the delivery chamber 21, with a unidirectional valve 51 being inserted in the line in such a way that the fuel may not pass from the delivery chamber 21 toward the first channel 28. Also included is a constriction 52 located downstream from valve 51, while the second channel, which corresponds to the activated position of the electrovalve 9, is connected to the medium pressure input line 26. A unidirectional flow valve 10 is also provided to fill the control chamber 31 with fuel at medium pressure MP via lines 26, 25, then 27.

Finally, line 23 connects the injection chamber 22 to the needle chamber 7 while the above-mentioned line 19 is connected to the control chamber 31 in such a way that the end of the injection stroke of the injection piston 8 causes the discharge of the needle chamber 7 toward the medium pressure MP and the discharge of the injection chamber 22 toward the control chamber 31, thereby ensuring the rapid reclosure of the needle 14.

If Sc designates the cross-section of the control chamber 31 and Pc designates control pressure, and Sa designates the needle cross-section, Ss the cross-section of its seat, Pi the injection pressure, and R the pressure of spring 12, the movement of the needle 14, its pushrod 13 and the control piston 11 taken together give rise on the one hand to a hydraulic needle lift force with a value of $Pi \cdot (Sa - Ss)$, directed upwards, and a control pressure of value $Pc \cdot Sc + R$, directed downwards.

The various parameters above are determined in such a way that the control pressure is considerably greater than the hydraulic lift force when $Pc = Pi = HP$, and that this same control pressure is substantially less than the hydraulic lift force when $Pc = MP$ and $Pi = HP$. Due to the great difference in force prevailing between HP and MP, this condition can be met very easily, with a high degree of reliability and within customary dimensions, at the pressure values indicated above.

Figure 3:
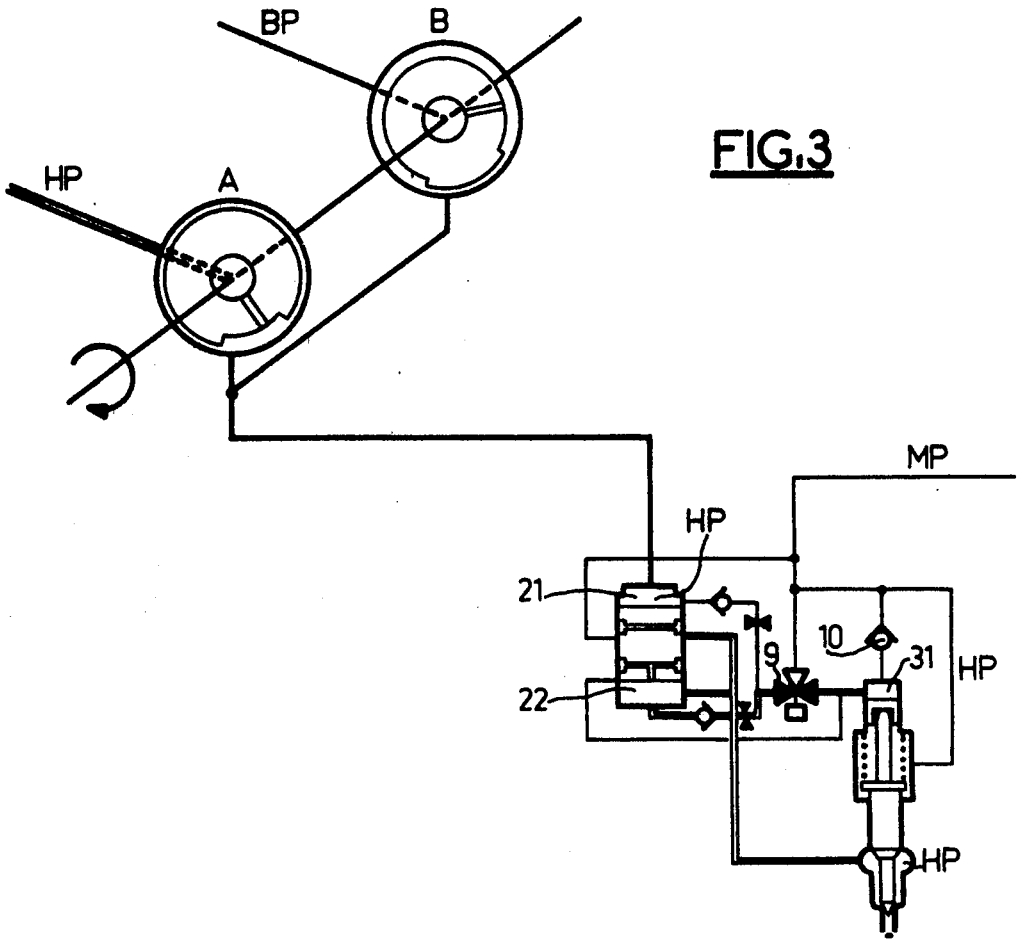
FIGS. 3 to 8 are partial diagrams illustrating the various phases of operation of the present invention.

The functioning of the unit, which is of course cyclical, periodically involves injection phases and premetering phases between the injection phases. When metering ends, the edge X of the box 35 of the distributor's low pressure stage B blocks line 37, and then edge Z of the high pressure stage A uncovers line 38, making it possible for high pressure HP to pass via lines 39 and 36 into the delivery chamber 21, which, on the one hand, through the intermediary of the injection piston 8, subjects the injection chamber 22 to a like pressure inasmuch as the fuel cannot pass from chamber 22 to the control chamber 31 because of unidirectional valve 50, and, on the other hand, subjects the control chamber to the same pressure via line 53 and electrovalve 9, which is in the rest position allowing for passage between channel 28 and line 24 (FIG. 2). In view of this basic design, internal leakage from the electrovalve 9 in no way modifies the premetered quantity of fuel in the injection chamber 22 under high pressure, since unidirectional valve 50 is hermetically sealed and the fuel source directly introducing high pressure into the control chamber 31 is the higher pressure pump 4, via lines 38, 39, 36, 29 and 53. A throttle valve 52 is judiciously located in line 53 downstream from unidirectional valve 51 in such a way that the pressure prevailing upstream of the channel 28 to the three-channel electrovalve 9 is always less than the pressure prevailing in the injection chamber 22, causing the unidirectional valve 50 to be continuously closed as soon as chamber 21 is placed under pressure. The unidirectional valve 10 maintains this high pressure from being discharged into the low pressure level, and line 23 likewise transmits this high pressure to the needle chamber 7. This results in the situation described above where the pressure injection chamber 22, control chamber 31 and needle chamber 7 are equal to the high pressure and, as noted, the control pressure is considerably greater than the hydraulic lift force of the needle 14 and maintains needle 14 in place on its seat. This is illustrated in FIG. 3.

Figure 4:
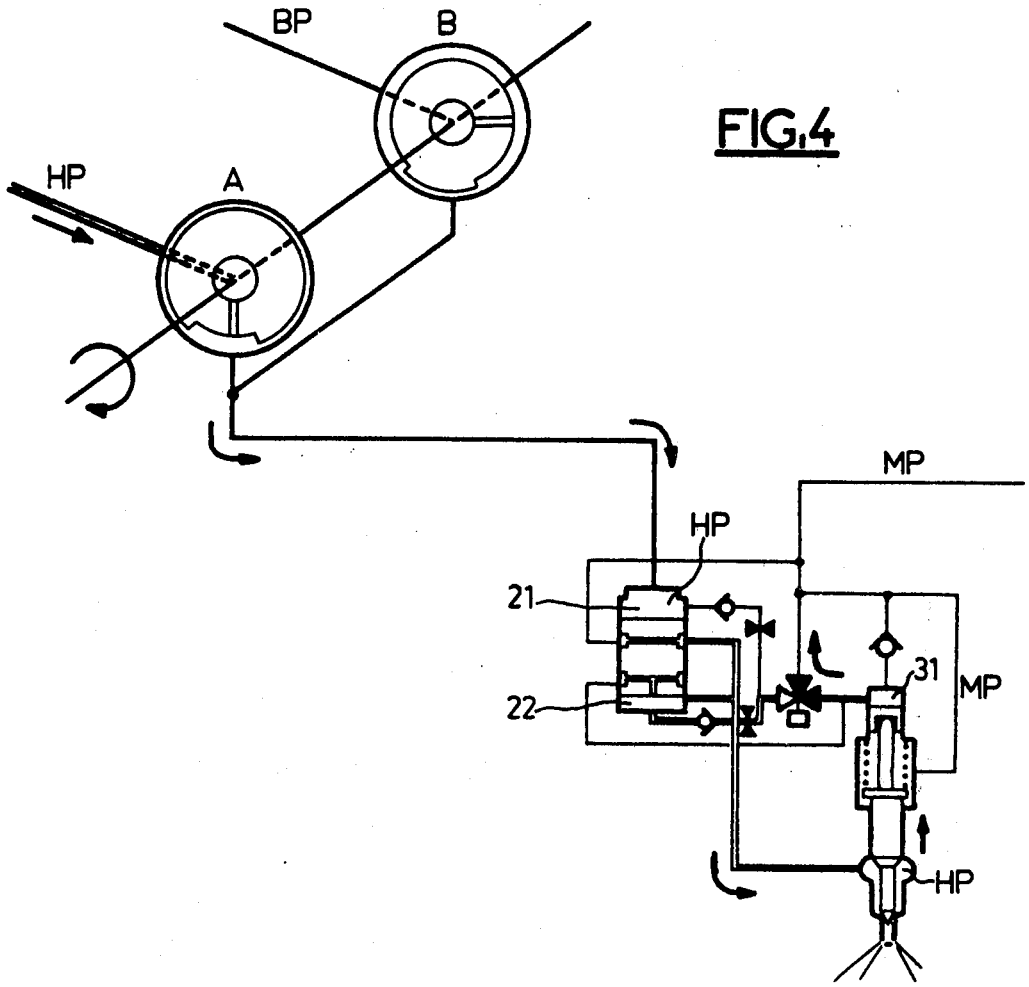

At the desired time for injection, which is electronically synchronized with precision in accordance with the motor position, the electrovalve 9 is electrically activated so as to connect lines 24 and 26, thus allowing the high pressure prevailing in the control chamber 31 to drop to the medium pressure level. This new condition is illustrated in FIG. 4. This is the situation described above where medium pressure prevails in control chamber 31 and high pressure in needle chamber 7 and where, as noted, the control pressure becomes significantly less than the hydraulic lift force, which then lifts the needle 14 to allow for injection of the fuel.

Figure 5:
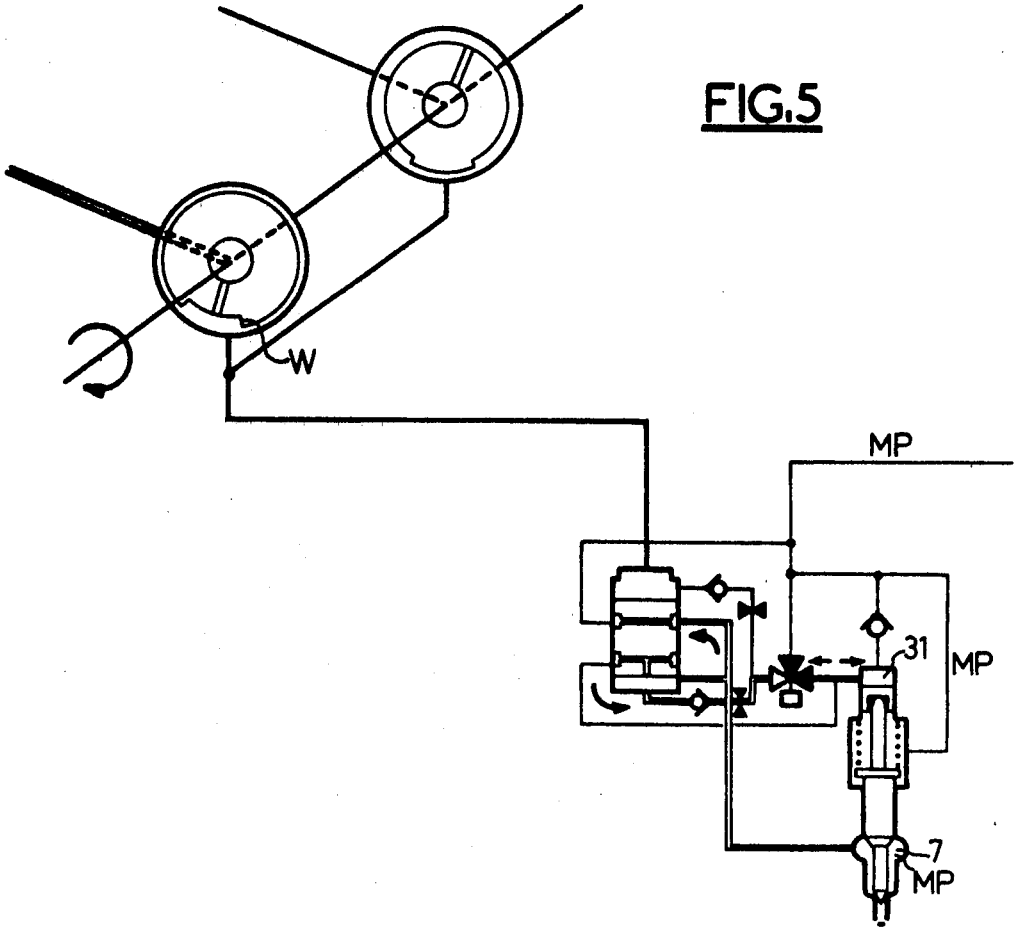

The premetered amount of fuel in the injection chamber 22 is then delivered under high pressure HP by the piston 8. Simultaneously, or with suitable time lags, one part of the lower edge of the piston 8 blocks line 23 while passage **20*b* connects line 43 with the medium pressure, and the fuel remaining in chamber 22 may be discharged into the control chamber 31 through line 19 and passage 20*a*, with the result that desired rapid closure of the injector is ensured by virtue of the combined effect of spring 12, the drop in pressure in needle chamber 7, and the increase in pressure in control chamber 31, while at the same time any recoil of the needle 14 is prevented by the recharging of the control chamber 31. This phase of operation is illustrated in FIG. 5**.

Figure 6:
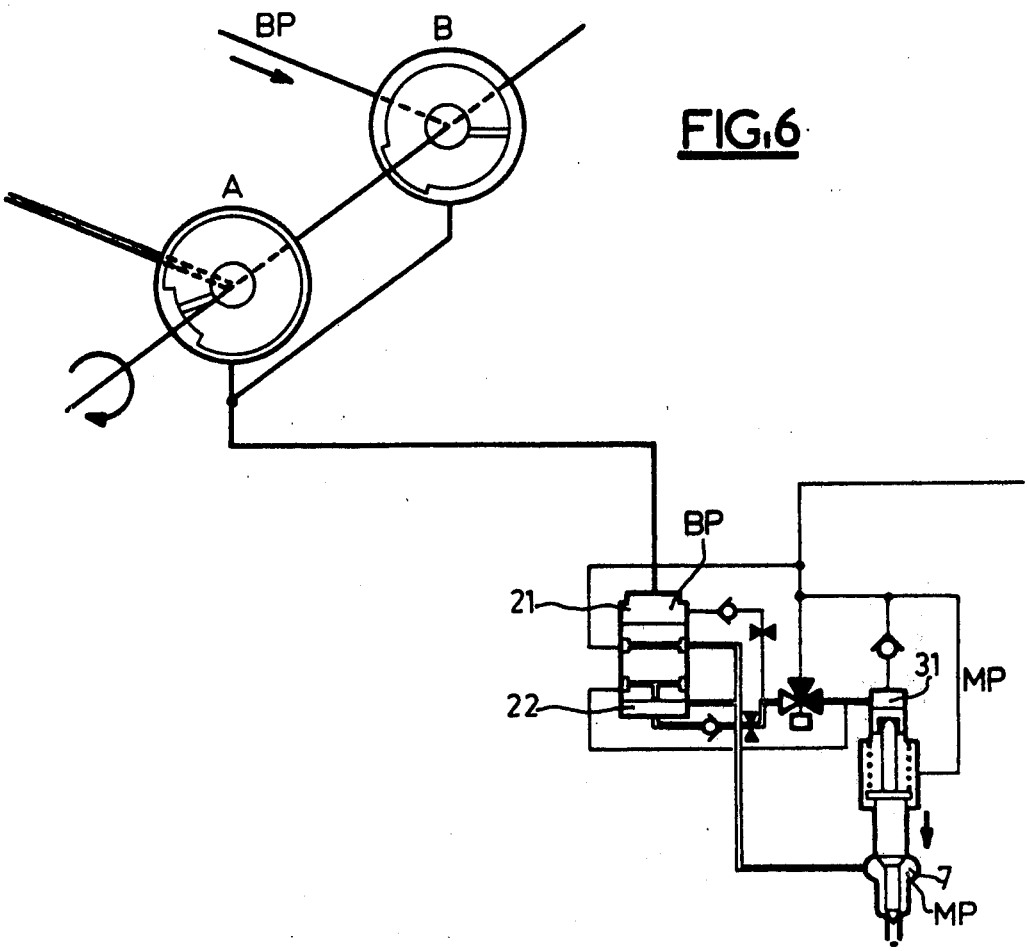

When the injection is completed, the electrovalve 9 remains under power, with the result that edge W of the high pressure stage A of the distributor blocks communication with line 38, after which edge Y of the low pressure stage B unblocks communication with line 37, allowing low pressure to prevail on the upper surface of the corresponding piston 8. This condition of operation is illustrated in FIG. 6.

Figure 7:
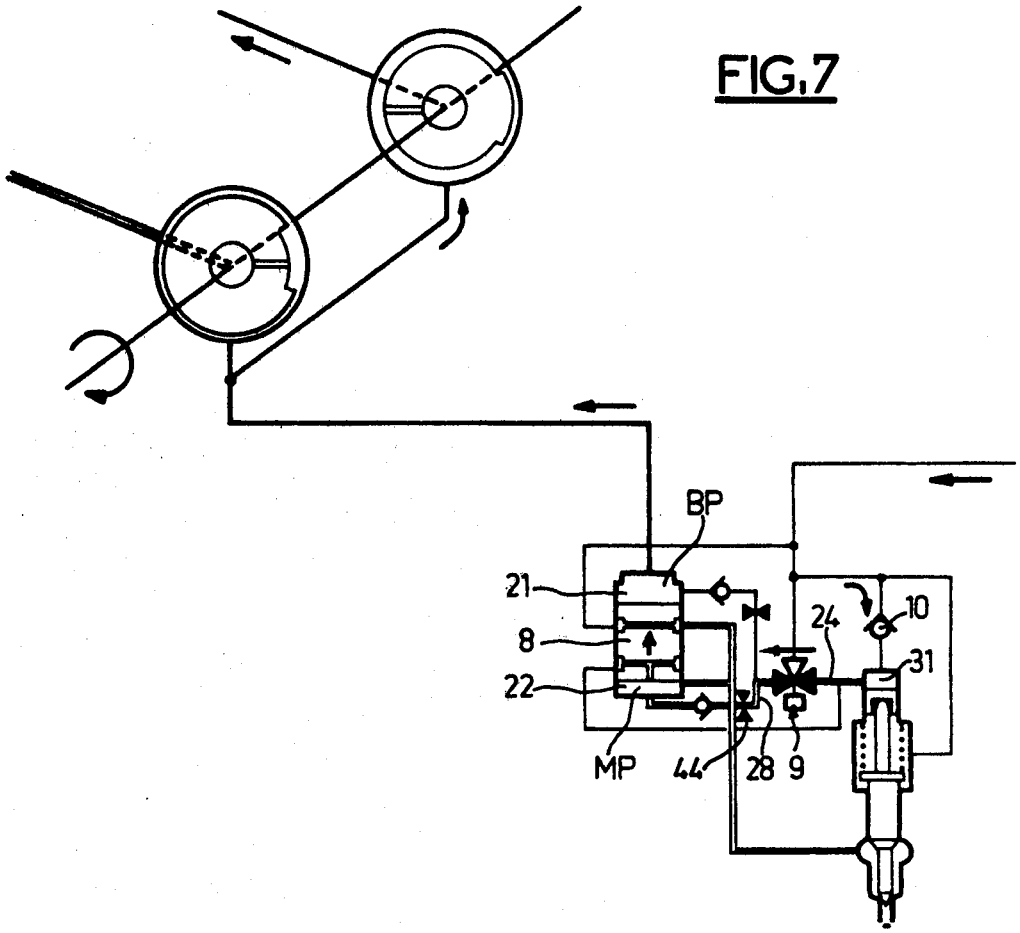

Under the circumstances previously defined, if the power feeds to the electrovalve 9 is cut off, electrovalve 9 returns to the the rest position as illustrated in FIG. 7 and communicates line 24 with line 28. Medium pressure then enters the control chamber 31 via unidirectional valve 10, moving from there through the electrovalve 9 into the injection chamber 22 via unidirectional valve 50 of a throttle valve 44, and moves the piston 8 inwardly since the upper surface thereof is under low pressure BP. The medium pressure therefore cannot flow toward the low pressure because of unidirectional valve 51.

Due to the throttle valve 44, but especially because of the low relative value of the pressure difference between MP and BP, the time during which this metering must take place remains relatively long, even for operation at a low load, allowing it to be regulated precisely by means of the electronic calculator which controls the injection.

Figure 8:
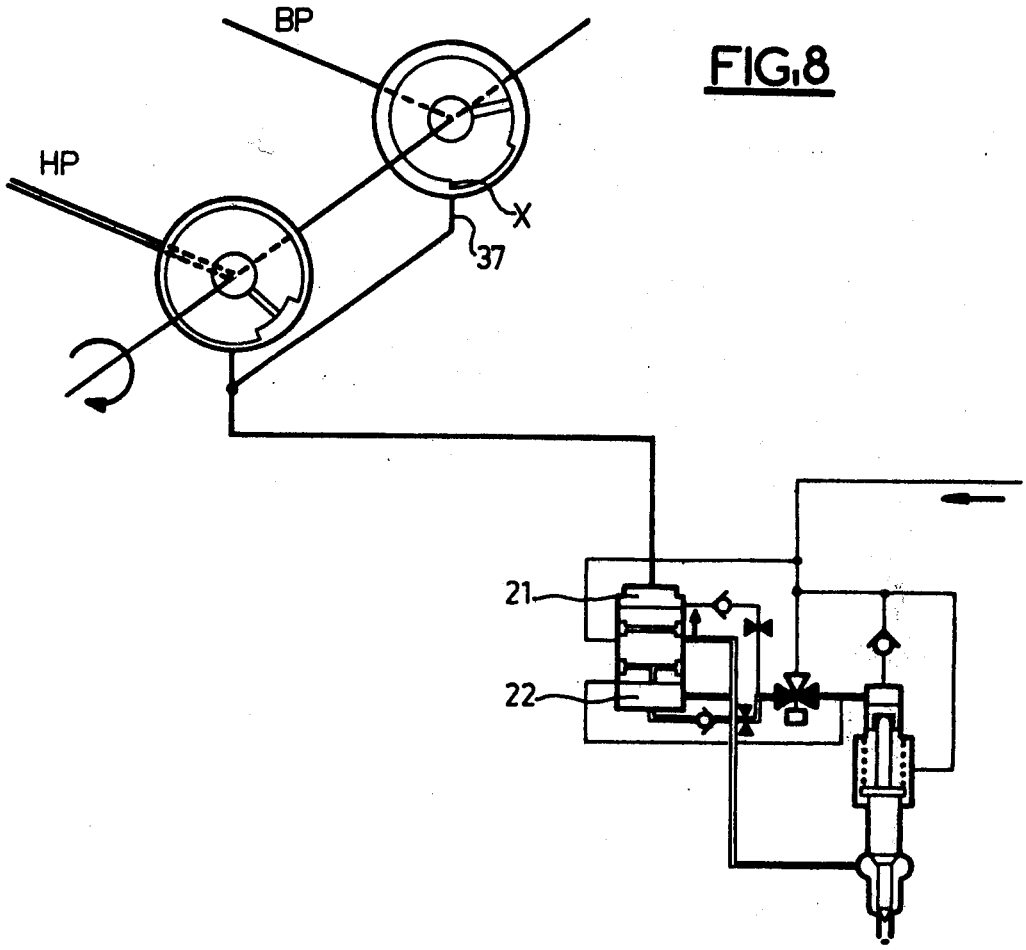

Moreover, whereas electrovalve 9 triggers the initiation of injection, stage B of the distributor determines the end of injection at the precise instant when edge X blocks line 37 as illustrated in FIG. 8, interrupting the upstroke of the piston 8 and hence terminating the metering in injection chamber 22. The electronic calculator, synchronized with the cycle of the motor, knows the exact instant of closing of line 37 and can thus calculate the metering time precisely.

The invention thus makes possible injection under extremely high pressure which is totally constant and regulated, as well as precise premetering, this while using just one electrovalve per cylinder which opens and closes only once per cycle and serves to trigger both the initiation of injection and the start of metering.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. An electronically controlled device for premetered pressure-time injection of a motor using a predetermined high injection pressure and low feed pressure, comprising:

means for supplying a predetermined medium pressure of a value which is intermediate said high and low pressures;

a plurality of cylinders mounted in said motor and operatively connected to said means for supplying said medium pressure;

a single piping system connected to each of said cylinders;

two stage, rotary distributor means for cyclically distributing the high and low pressure as a function of the number of said cylinders into said single piping system for each of said cyclinders, without overlapping of high pressure and low pressure communication time periods;

a plurality of injector nozzle units which are each respectively operatively associated with each of said cylinders and wherein each of said injector nozzle units further comprise;

an injector having a needle chamber formed therein;

an injector nozzle;

a metering piston mounted in said injector nozzle wherein a delivery chamber, injector chamber and control chamber are formed in said injector nozzle and connected to said single piping system of a corresponding cylinder and wherein the injector chamber is connected to the needle chamber of the injector;

a first unidirectional flow valve;

a medium pressure channel formed in said injector nozzle unit;

a second channel formed in said injector nozzle unit;

a three-channel electrovalve; and an injector control piston wherein the control chamber is connected, on the one hand, to the means for supplying a medium pressure through said unidirectional flow valve and wherein said unidirectional control valve is positioned in a direction for allowing said control chamber to be fueled, and, on the other hand, via three-channel electrovalve, through said medium pressure channel, for initiating injection, and through the second channel, to the injection chamber for initiating metering; and electronic means synchronized with the rotation of the distributor and of the motor for triggering initiation of injection and initiation of metering by means of the electrovalve.

2. An injection device according to claim 1, wherein said injector further comprises a needle mounted in said needle chamber and further comprising means for determining a plurality of parameters, cross sections and calibrations of the injector, as well as said medium pressure, such that the control pressure tending to reclose the needle of each said injector is significantly greater than a hydraulic lift force of said needle when said high injection pressure prevails in both the injection chamber and the control chamber and considerably less than said hydraulic lift force when medium pressure of said means for supplying the medium pressure prevails in the control chamber and said high pressure prevails in the needle chamber.

3. A device according to claims 1 and 2, further comprising means for providing hydraulic connection between said second channel of the electrovalve and said injection chamber and which further comprises a second unidirectional flow valve for opening the electrovalve and permitting flow toward said injection chamber, and further comprising means for providing hydraulic connection between said delivery chamber and said second channel and which further comprises a third unidirectional flow valve for allowing the delivery chamber to be discharged towards the electrovalve, and a throttle valve for creating, during said flow, a sufficient loss of pressure to maintain the second valve closed and to make the premetered amount insensitive to any internal leakage of the electrovalve.

4. A device according to claims 1 or 2 wherein each of said injector nozzle units includes a plurality of fixed lines operatively associated with said metering piston and wherein said metering piston has a first and second passage formed therein for communicating with said fixed lines so as to insure that, at the end of an injection stroke, discharge of the needle chambers towards the medium pressure channel occurs and that discharge of the injection chamber occurs towards the control chamber.

5. A device according to claims 1 or 2, further comprising a single pump for exclusive generation of said high pressure and medium pressure and wherein said means for supplying a medium pressure further comprises a two-stage flow regulator.

* * * * *